US010210684B2

(12) United States Patent
Torgersrud et al.

(10) Patent No.: US 10,210,684 B2
(45) **Date of Patent: *Feb. 19, 2019**

(54) SYSTEM AND METHOD FOR IDENTITY VERIFICATION IN A DETENTION ENVIRONMENT

(71) Applicant: Intelmate LLC, San Francisco, CA (US)

(72) Inventors: Richard Torgersrud, San Francisco, CA (US); Kevin O'Neil, Parma, ID (US); Christopher Ditto, San Jose, CA (US); Grant Gongaware, San Francisco, CA (US); Kevin E. Krauss, San Francisco, CA (US); Erik Petersen, San Francisco, CA (US)

(73) Assignee: INTELMATE LLC, San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/347,249

(22) Filed: Nov. 9, 2016

(65) Prior Publication Data

US 2017/0061718 A1 Mar. 2, 2017

Related U.S. Application Data

(63) Continuation of application No. 13/490,054, filed on Jun. 6, 2012, now Pat. No. 9,524,595.

(51) Int. Cl.
*G07C 9/00* (2006.01)

(52) U.S. Cl.
CPC ..... *G07C 9/00142* (2013.01); *G07C 9/00031* (2013.01); *G07C 9/00103* (2013.01); *G07C 9/00134* (2013.01); *G07C 9/00166* (2013.01)

(58) Field of Classification Search
CPC ..... G07C 9/00031; G07C 9/00103; G07C 9/00134; G07C 9/00142; G07C 9/00166; G06F 21/32; G06Q 20/10; G06Q 20/40; G06Q 20/4014; G06Q 20/40145; H04L 63/0861; H04M 3/2281; H04M 3/382
See application file for complete search history.

(56) References Cited

U.S. PATENT DOCUMENTS 4,843,377 A 6/1989 Fuller et al.
5,170,426 A 12/1992 D'Alessio et al.
(Continued)

FOREIGN PATENT DOCUMENTS

| | | | |
|---|---|---|---|
| CA | 2144303 | A1 | 3/1994 |
| CA | 2355360 | A1 | 4/2001 |
| CA | 2596592 | A1 | 8/2006 |
| CA | 2593067 | A1 | 12/2007 |
| CA | 2631578 | A1 | 11/2008 |
| CA | 2639360 | A1 | 3/2009 |
| CA | 2639372 | A1 | 3/2009 |

OTHER PUBLICATIONS

Cisco, JAMS Information Whitepaper, Version 12, www.cisco-ps.com, pp. 1-11, New Port.Richey, FL 34652.
(Continued)

*Primary Examiner* — Orlando Bousono
(74) *Attorney, Agent, or Firm* — Venable LLP; Jeffri A. Kaminski

(57) ABSTRACT

A system and method for identity verification in a detention environment and for tracking information between individuals in a detention environment with individuals who are not in the detention environment across disparate functional systems.

18 Claims, 4 Drawing Sheets

(56) References Cited

U.S. PATENT DOCUMENTS 5,193,365 A 3/1993 Nelson
5,461,390 A 10/1995 Hoshen
5,485,507 A 1/1996 Brown et al.
5,657,389 A * 8/1997 Houvener ..... G06Q 20/04 235/380
6,054,928 A 4/2000 Lemelson et al.
7,039,171 B2 5/2006 Gickler
7,106,843 B1 9/2006 Gainsboro et al.
7,130,800 B1 * 10/2006 Currey ..... G10L 17/00 379/88.22
7,278,028 B1 10/2007 Hingoranee
7,333,798 B2 2/2008 Hodge
7,466,816 B2 12/2008 Blair
7,664,689 B1 * 2/2010 Rosenfield ..... G06Q 20/10 705/35
7,805,457 B1 9/2010 Viola et al.
7,844,252 B2 11/2010 Hodge
7,853,243 B2 12/2010 Hodge
7,860,222 B1 12/2010 Sidler et al.
7,860,968 B2 12/2010 Bornhoevd et al.
7,889,847 B2 2/2011 Gainsboro
7,961,858 B2 6/2011 Polozola et al.
7,979,379 B2 7/2011 Voegele et al.
8,046,230 B1 * 10/2011 McIntosh ..... G07C 9/00166 379/88.02
8,065,213 B2 11/2011 Rosenfield et al.
8,099,080 B1 1/2012 Rae et al.
8,200,980 B1 * 6/2012 Robinson ..... G06Q 20/04 713/186
8,478,234 B1 * 7/2013 Byrne ..... H04M 3/2281 455/406
8,527,773 B1 * 9/2013 Metzger ..... G06F 21/31 380/255
9,189,788 B1 * 11/2015 Robinson ..... G06Q 20/40145
2002/0067272 A1 6/2002 Lemelson et al.
2002/0138351 A1 * 9/2002 Houvener ..... G06Q 10/10 705/18
2002/0178364 A1 * 11/2002 Weiss ..... G06F 21/6245 713/182
2003/0070101 A1 * 4/2003 Buscemi ..... H04L 63/08 726/8
2003/0086594 A1 * 5/2003 Gross ..... G06F 21/6245 382/118
2003/0174059 A1 9/2003 Reeves
2003/0182182 A1 * 9/2003 Kocher ..... G07C 13/00 705/12
2003/0221125 A1 * 11/2003 Rolfe ..... G06F 21/42 705/12
2004/0029564 A1 * 2/2004 Hodge ..... H04M 1/67 455/411
2004/0114740 A1 * 6/2004 Gickler ..... G06F 21/55 379/114.14
2004/0153655 A1 * 8/2004 Rolfe ..... G06F 21/32 713/185
2004/0172340 A1 * 9/2004 Bishop ..... G06Q 30/0269 705/50
2004/0189441 A1 * 9/2004 Stergiou ..... G06Q 20/4014 340/5.51
2004/0215557 A1 * 10/2004 Michelsen ..... G06Q 20/10 705/39
2004/0215574 A1 * 10/2004 Michelsen ..... G06Q 20/04 705/64
2004/0243518 A1 * 12/2004 Clifton ..... G06Q 20/4012 705/72
2005/0119968 A1 * 6/2005 Michelsen ..... G06Q 20/04 705/39
2005/0125226 A1 * 6/2005 Magee ..... G06F 21/32 704/246
2005/0125686 A1 * 6/2005 Brandt ..... H04L 63/1466 726/22
2005/0259801 A1 11/2005 Bullard et al.
2006/0010487 A1 * 1/2006 Fierer ..... G06F 21/32 726/5
2006/0047725 A1 * 3/2006 Bramson ..... G06F 21/604
2006/0102717 A1 * 5/2006 Wood ..... G06Q 10/10 235/382
2006/0106605 A1 5/2006 Saunders et al.
2006/0184801 A1 * 8/2006 Wood ..... G07C 9/00031 713/186
2006/0206724 A1 * 9/2006 Schaufele ..... G06F 21/32 713/186
2006/0239512 A1 * 10/2006 Petrillo ..... G06F 21/31 382/115
2006/0285667 A1 * 12/2006 Hodge ..... H04M 1/67 379/142.05
2007/0041545 A1 * 2/2007 Gainsboro ..... H04M 3/2281 379/188
2007/0074021 A1 * 3/2007 Smithies ..... G06F 21/32 713/168
2007/0118549 A1 * 5/2007 Bornhoevd ..... G06F 9/5027
2007/0160189 A1 * 7/2007 Blair ..... H04M 3/42221 379/265.04
2007/0174186 A1 * 7/2007 Hokland ..... G06Q 20/02 705/39
2007/0177768 A1 * 8/2007 Tsantes ..... G06Q 30/00 382/115
2007/0208662 A1 * 9/2007 Jeronimus ..... G06Q 20/10 705/44
2007/0263812 A1 * 11/2007 Polozola ..... G06Q 20/04 379/144.02
2008/0005576 A1 * 1/2008 Weiss ..... G06F 21/6245 713/182
2008/0040780 A1 * 2/2008 Reinhold ..... H04L 63/0861 726/5
2008/0130957 A1 * 6/2008 Small ..... G06F 19/322 382/115
2008/0304643 A1 * 12/2008 Hodge ..... H04M 1/67 379/188
2009/0112754 A1 * 4/2009 Seifert ..... G06Q 20/02 705/39
2009/0164407 A1 * 6/2009 Voegele ..... G06F 11/3466 706/52
2009/0177626 A1 7/2009 Lottero
2009/0265106 A1 10/2009 Bearman et al.
2009/0265773 A1 * 10/2009 Schultz ..... H04L 63/08 726/7
2009/0305667 A1 * 12/2009 Schultz ..... H04L 63/08 455/410
2009/0305670 A1 * 12/2009 DeBoer ..... G06Q 20/32 455/411
2009/0320101 A1 * 12/2009 Doyle, III ..... G06F 21/31 726/4
2010/0100479 A1 * 4/2010 Rosenfield ..... G06Q 20/10 705/39
2010/0189228 A1 7/2010 Seyfetdinov
2010/0295656 A1 * 11/2010 Herickhoff ..... H04L 63/08 340/3.1
2011/0066553 A1 * 3/2011 Seifert ..... G06Q 20/02 705/44
2011/0286585 A1 11/2011 Hodge
2011/0317685 A1 12/2011 Torgersrud et al.
2011/0320484 A1 * 12/2011 Smithies ..... G06F 21/32 707/769
2012/0059760 A1 * 3/2012 Rosenfield ..... G06Q 20/10 705/39
2013/0002433 A1 1/2013 Wilmeth et al.
2013/0036458 A1 * 2/2013 Liberman ..... H04L 9/3231 726/6
2013/0091581 A1 * 4/2013 Pirani ..... G06F 21/31 726/26

OTHER PUBLICATIONS

Jeong, Min-A, Kim, Jung-Ja and Won, Yonggwan; *A Flexible Database Security System Using Multiple Access Control Policies*, © 2003, IEEE, Republic of Korea, pp. 236-240.

VirtuSync; VirtuSync Prison Manager Solution, Offender Mangement System (OMS); http://www.virtusync.com/prison_mngr.php, Feb. 27, 2012, pp. 1-2.

(56) References Cited

OTHER PUBLICATIONS

Access Securepak®, https://www.accesscatalog.com/index.html?; Copyright © 2012, Centric Group, LLC., Feb. 27, 2012, pp. 1-1.
Cisco Software—JAMS—Jail Administration and Management Software, JAMS—Jail Administration and Management System, http://www.cisco-ps.com/jams/—copyright 1982-2011, Feb. 27, 2012, pp. 1-6, New Port Richey, FL 34652.
Lock&Track$^{SM}$, Comprehensive Overview (For decision makers.), LockWorks LLC, Copyright © 2009, Document version of Feb. 25, 2009, http://www.locktrack.com, Kiowa, CO 80117, pp. 1-5.
Torgersrud et al., Interactive Audio/Video System and Device for Use in a Secure Facility; U.S. Appl. No. 13/088,883, filed Apr. 18, 2011.
Torgersrud et al., Secure Social Network; U.S. Appl. No. 13/438,940, filed Apr. 4, 2012.

* cited by examiner

SYSTEM AND METHOD FOR IDENTITY VERIFICATION IN A DETENTION ENVIRONMENT

CROSS REFERENCE TO RELATED APPLICATIONS

This application is a continuation of U.S. application Ser. No. 13/490,054 filed on Jun. 6, 2012, published Dec. 12, 2013 as U.S. 2013/0328664, currently pending, which is incorporated by reference in its entirety herein.

FIELD

The present disclosure relates to methods and systems used in a detention environment for verifying an individual's identity.

BACKGROUND

Detention environments, such as a jail, prison, detention facility, secured hospital, or addiction treatment facility, house large populations of individuals in confinement, which presents unique administrative challenges. Notably, detention environments require additional levels of monitoring and oversight that are not required when similar services are provided to other populations. In monitoring and overseeing a detention environment, a verification process to establish the truth, accuracy, or validity of an individual's identity is typically required.

Throughout a detention environment, there are disparate types of interactions that may need to be monitored including e.g., visitations, monetary deposits, bail or bond payments, phone calls, voicemail messages, and correspondence to/from individuals in the detention environment. Current jail management systems utilize different methods and procedures to verify an individual who wishes to engage in these types of interactions. Some jail management systems verify an individual's identity by checking a government identification document, credit card, phone number, or simply the honesty of the individual. There needs to be a better way to identify individuals.

Moreover, due to the implementation of computerized systems, information is growing at a rate where it is increasingly difficult to extract useful information from data obtained through these interactions. Most of the information being gathered at detention environments is dynamic because the individuals in the detention environment are continuously interacting with one another and with individuals outside of the detention environment. With more effective ways to verify individuals, it would be possible to gather more accurate information, and reveal significant interactions as the information becomes available. Thus, there is a need for a dynamic centralized verified identity system operable across disparate types of interactions in a detention environment.

SUMMARY

As described more fully below, the embodiments of the present disclosure relate to a method and system for identity verification in a detention environment.

A method of identifying a first individual attempting to interact with a second individual is provided. The second individual is associated with a detention environment and the said method comprises storing identity information from a data source into a centralized database, the centralized database being accessible by disparate interactions related to the detention environment; receiving identity information from the first individual when attempting to interact with the second individual; and verifying the first individual by comparing the received identity information to the shared identity information in the centralized database.

In some embodiments, the storing step occurs prior to the first individual's interaction with the second individual. In another embodiment, the method further comprises supplementing the centralized database with the received information and a record of the attempted interaction.

These, as well as other components, steps, features, objects, benefits, and advantages will now become clear from a review of the following detailed description of illustrative embodiments, the accompanying drawings and the claims. It is to be expressly understood, however, that the drawings are for the purpose of illustration only and are not intended as a definition of the limits of the claimed embodiments.

BRIEF DESCRIPTION OF THE DRAWINGS

The drawings disclose illustrative embodiments. They do not set forth all embodiments. Other embodiments may be used in addition or instead. Details that may be apparent or unnecessary may be omitted to save space or for more effective illustration. Conversely, some embodiments may be practiced without all of the details that are disclosed. When the same numeral appears in different drawings, it is intended to refer to the same or like components or steps.

DETAILED DESCRIPTION OF ILLUSTRATIVE EMBODIMENTS

Illustrative embodiments are now discussed. Other embodiments may be used in addition or instead. Details that may be apparent or unnecessary may be omitted to save space or for a more effective presentation. Conversely, some embodiments may be practiced without all of the details that are disclosed.

This disclosure relates to methods and systems used in a detention environment for verifying an individual's identity utilizing a centralized database operable across disparate types of interactions. Current methods and systems for identity verification in detention environments are non-uniform for disparate types of interactions and the methods and systems are not easily compatible with one another. Therefore, it is difficult to track interactions of an individual and an individual subject to the detention environment. The disclosed method and system verify all individuals contacting, interacting with or otherwise connecting to an individual subject to the detention environment. In contrast, those individuals subject to the detention environment, such as inmates, patients, or detainees, may be verified using existing methods and systems since it is possible to obtain a wide range of information from the individual when they are in the detention environment. For example, when a prisoner is processed through a jail, it is common for the jail to obtain the prisoner's identity information such e.g., as fingerprints, DNA samples, and voice samples.

Figure 1:
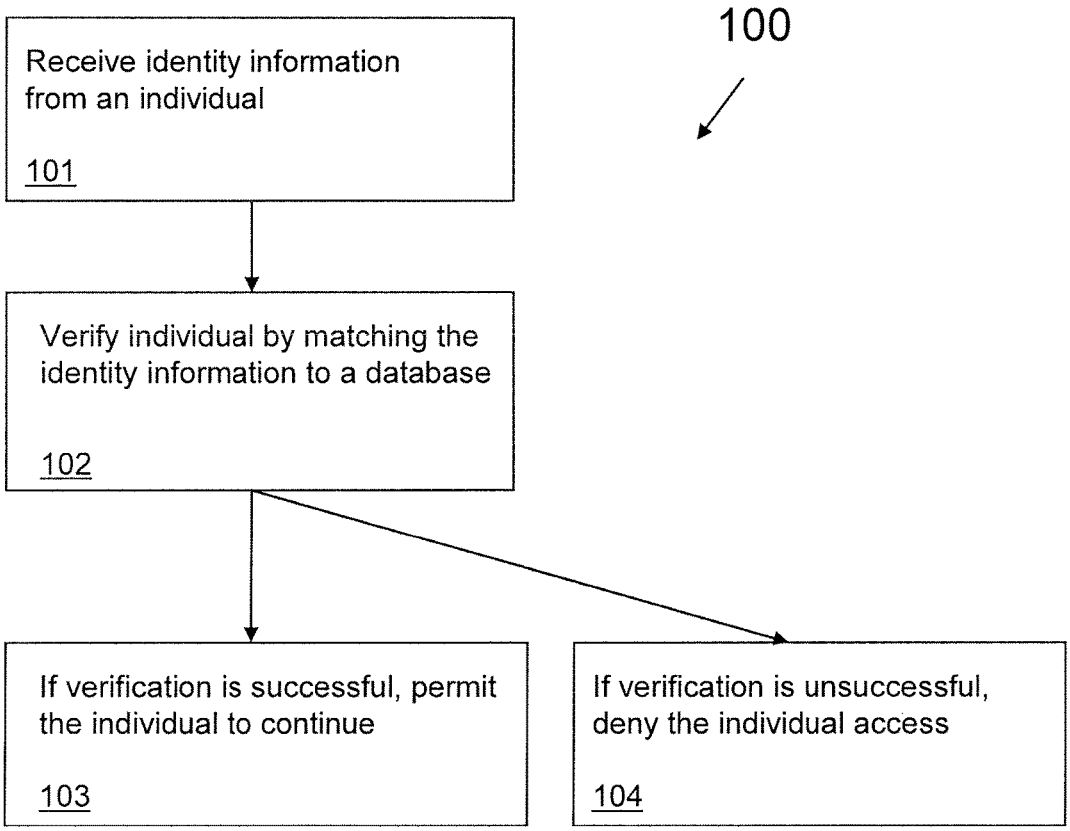
FIG. 1 is a diagram illustrating one embodiment of a method according to aspects of the present disclosure.

FIG. 1 is a diagram illustrating one embodiment of a method 100 according to aspects of the present disclosure. The method 100 is designed for use within a detention environment or as part of a method monitoring a detention environment. This method 100 applies to anyone who attempts to interact with an individual subject to a detention environment, for example, by visiting or making a transaction on behalf of the individual subject to the detention environment.

As used herein, the term "individual" is used to refer to a person attempting to interact with, or on behalf of, a person subject to the detention environment who will be referred to herein as the "individual subject to the detention environment." The method 100 receives the individual's identity information at step 101 by way of a programmable device or system, such as e.g., a computer, a call screening system, a detention environment guard, or an interactive audio/video system and device for use in a detention environment disclosed in U.S. patent application Ser. No. 13/088,883, which is incorporated by reference herein. It should be appreciated that where a definition or use of a term in an incorporated application or reference is inconsistent with or contrary to the definition of that term provided herein, the definition of that term provided herein applies. The individual could be prompted to input identity information, such as, the zip code of their residence, mother's maiden name, a number of digits of the applicant's social security number, or other questions that lead to a unique individual. Identity information may also be contained in an identification card, which is processed by the programmed device or system, and may assist with the verification process. As just one example, an individual may scan their driver's license, and the programmed device or system may read the license, and fill out form fields such as name, address, and gender based on information on the license. This process may be implemented by use of a magnetic strip, a two dimensional or three dimensional bar code, or optical character recognition. Identity information may also be biometric information, such as, facial recognition, body recognition, voice recognition, retinal scan, fingerprint, DNA sample, or palm print. Identity information may also come from an interaction with the individual's phone, such as, swiping a phone through a scanner, keying in a unique phrase or number that was sent to a phone, or answering a call made to the individual's phone.

The method 100 is also designed to verify an individual's identity by matching the individual's identity information with information in a database (at step 102). The database is populated with identity information from a data source or a plurality of data sources. In some cases the identity information from the data source existed prior to the individual's interaction with the individual subject to the detention environment. These data sources may include: line information databases to find phone number and address associations; best known name and address databases to associate names with addresses; identification verification databases to match a provided name with digits of a social security number or other unique participant-assigned number; national financial information databases for existing financial records; national passport database; other government issued identification database such as a drivers' license database, a military identification database, or state issued identification card database; open warrants database; a national victim notification network such as VINE or VINELink; or a "do not contact" database. The database may also be populated by the data sources upon command, at intervals, or dynamically.

The method 100 is also desirably compatible with a data source such as the consolidated voicemail platform disclosed in U.S. patent application Ser. No. 12/826,168, which is incorporated by reference herein, and an information exchange facilitating system such as e.g., the secure social network disclosed in U.S. patent application Ser. No. 13/438,940, which is also incorporated by reference herein.

In some circumstances, an investigator will review attempted interactions with individuals subject to the detention environment. As just one example, an individual will attempt to interact by depositing money in the commissary account of an individual subject to the detention environment. The method 100 will check the database, and ask the individual enough questions until the method 100 is able to positively match the individual's identity information with information in the database. A consequence of this method 100 is that individuals will be verified upon each attempted interaction. For example, there may be several variations of J. Jones, J. D. Jones, Jonathan Jones, and John Jones appearing in a criminal investigation that involves attempted interactions with an individual subject to a detention environment. The identification of a J. Jones in a metropolitan area may require an extraordinary effort. Since the disclosed method 100 requires verification of an individual before he/she is allowed to interact with an individual subject to the detention environment, the disclosed method 100 may pinpoint the identity to a distinct individual named Jonathan D. Jones.

In an additional embodiment, the step of receiving identity information may also include receiving additional information from the individual after the individual is verified, such as e.g., a photograph or digital image of the individual, a scan of the individual's identification card, and additional information from additional questions. After the individual is verified, the individual may also establish a username and password, or a unique personal identification phrase, number, or series of characters. This establishment of a username and password would facilitate an additional identification process during future attempted interactions.

In another embodiment, the disclosed method supplements a verified identity with additional information from the database such as e.g., a date of birth, an address, and/or a photograph. In yet another embodiment, information, such as a phone number, associated with the individual is found to be associated with previous phone calls made by the individual subject to the detention environment. In this case, the disclosed method may associate those previous phone calls with the verified identity information, allowing the method to retroactively link a person in a detention environment to a specific verified person through a phone number. Similar associations could be made through credit card data, address data, and more.

In another embodiment, when an individual had been previously verified, the method 100 may receive a previously verified individual's username and password as the identity information during the verification process (i.e., step 101). The method 100 may also receive a previously verified individual's physical attributes as the identity information during the verification process. The physical attributes may include a voiceprint comparison, facial or body recognition, DNA sample, retinal scan, or other form of biometric attribute. The method 100 may also receive a previously verified individual's identification credential as the identity information during the verification process; this may include a passport, drivers license, military identification, or similar. The method 100 may also receive during the verification process a previously verified individual's mobile phone interaction as the identity information, which may involve responding to a phone call or text message, or requiring the previously verified individual to call or text message to a specific phone number. In the absence of all other means of identification, or as a means to expedite the process, the method 100 may receive a detention environment staff member's authorization to authenticate a verified individual by sight, or through spoken or direct questions.

After step 102 is complete, the method 100 will either verify or not verify an individual's identity. The method 100 will either permit the individual to continue if the individual is verified at step 103, or deny the individual access if the individual is not verified at step 104. If the individual is not permitted to continue, then the method may proceed to the additional steps shown in FIG. 2. If the individual is permitted to continue, then the method may proceed to the additional steps shown in FIG. 3.

Figure 2:
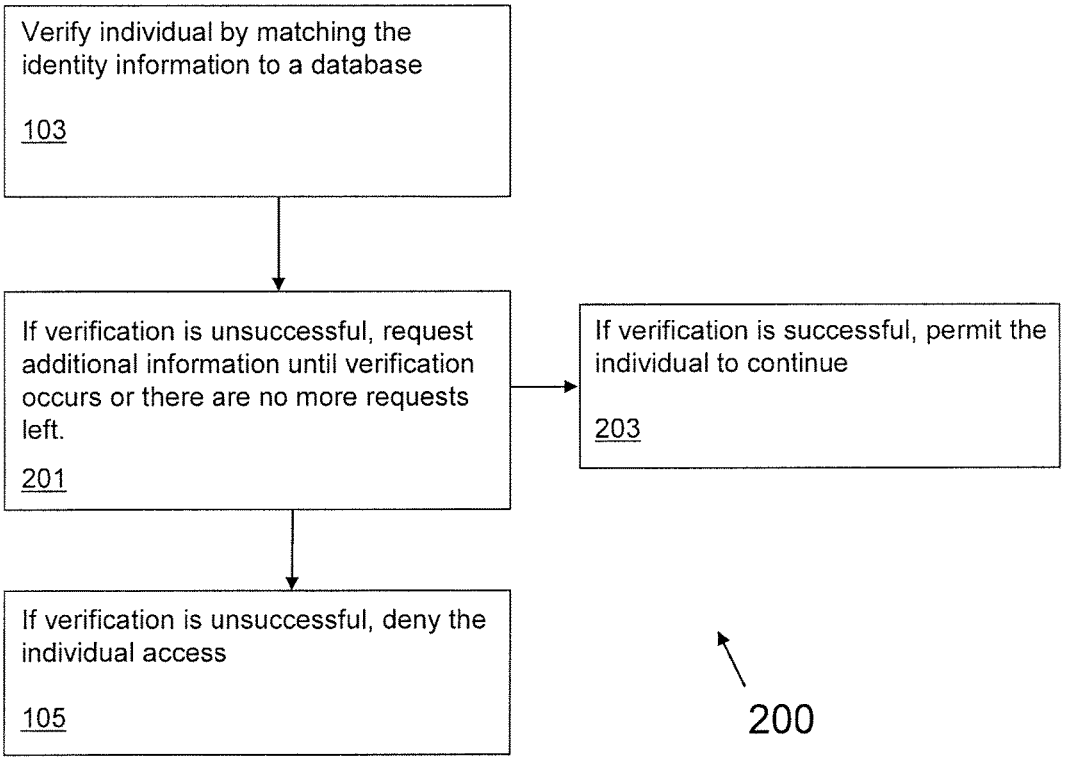
FIG. 2 is a diagram illustrating one embodiment of an additional method that may occur according to aspects of the present disclosure.

FIG. 2 illustrates an additional method 200 designed for use when method 100 receives an individual's identity information, but fails to verify the individual. In that circumstance, method 200 will request additional identity information from the individual until a match is found or there are no more requests left to issue (step 201). The method 200 may request as many types of identity information from an individual as there are in the database. If verification is successful, the method 200 permits the individual to interact with the detention environment at step 203. If the verification is still unsuccessful, then the method 200 denies the individual interaction with the individual subject to the detention environment (step 104).

Figure 3:
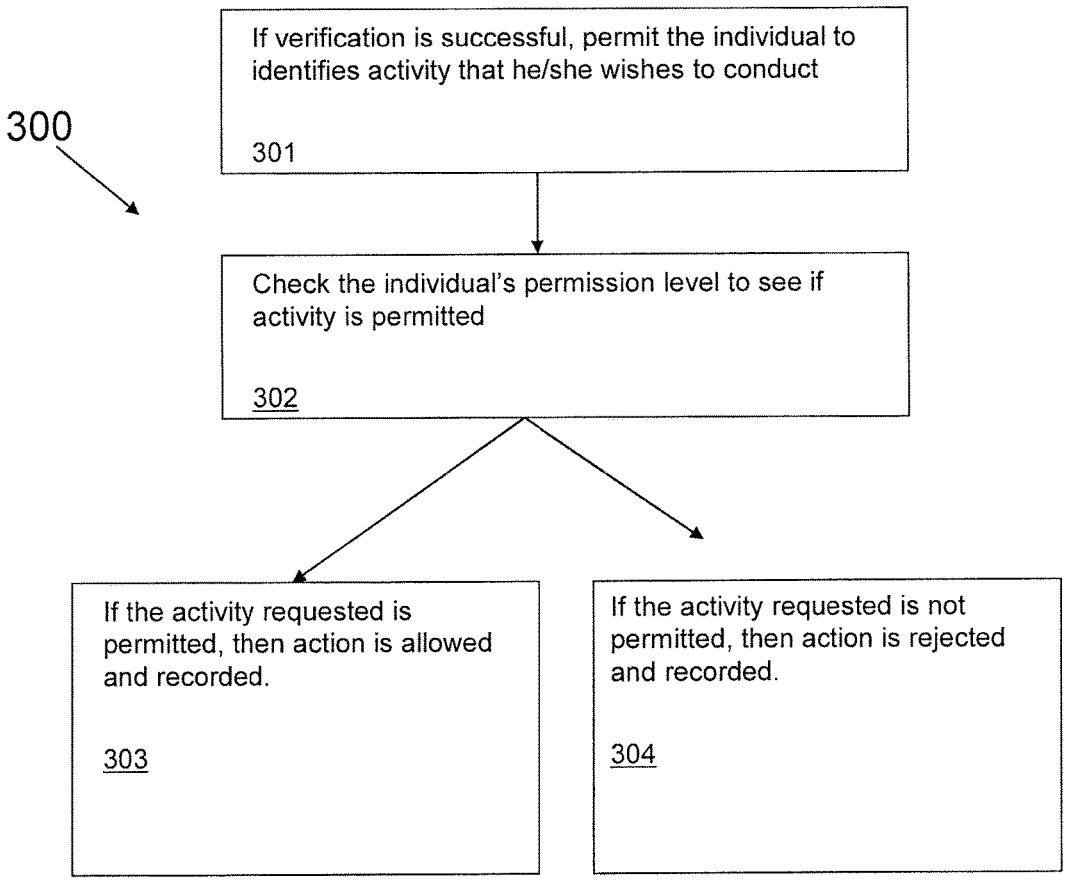
FIG. 3 is a diagram illustrating one embodiment of another additional method that may occur after an individual is verified according to aspects of the present disclosure.

FIG. 3 illustrates an additional method 300 designed to check an individual's permission level to determine whether a requested interaction is allowed. Once verification is successful (step 103/203), the method 300 permits the individual to request a particular interaction to conduct at step 301 (e.g., placing a telephone call). The method 300 then checks the verified individual's permission level to see if the requested activity is permitted (step 302). If the interaction requested is permitted, the method 300 permits the interaction and records the interaction at step 303. If the activity requested is not permitted, then the interaction is rejected and the attempt is recorded at step 304.

Figure 4:
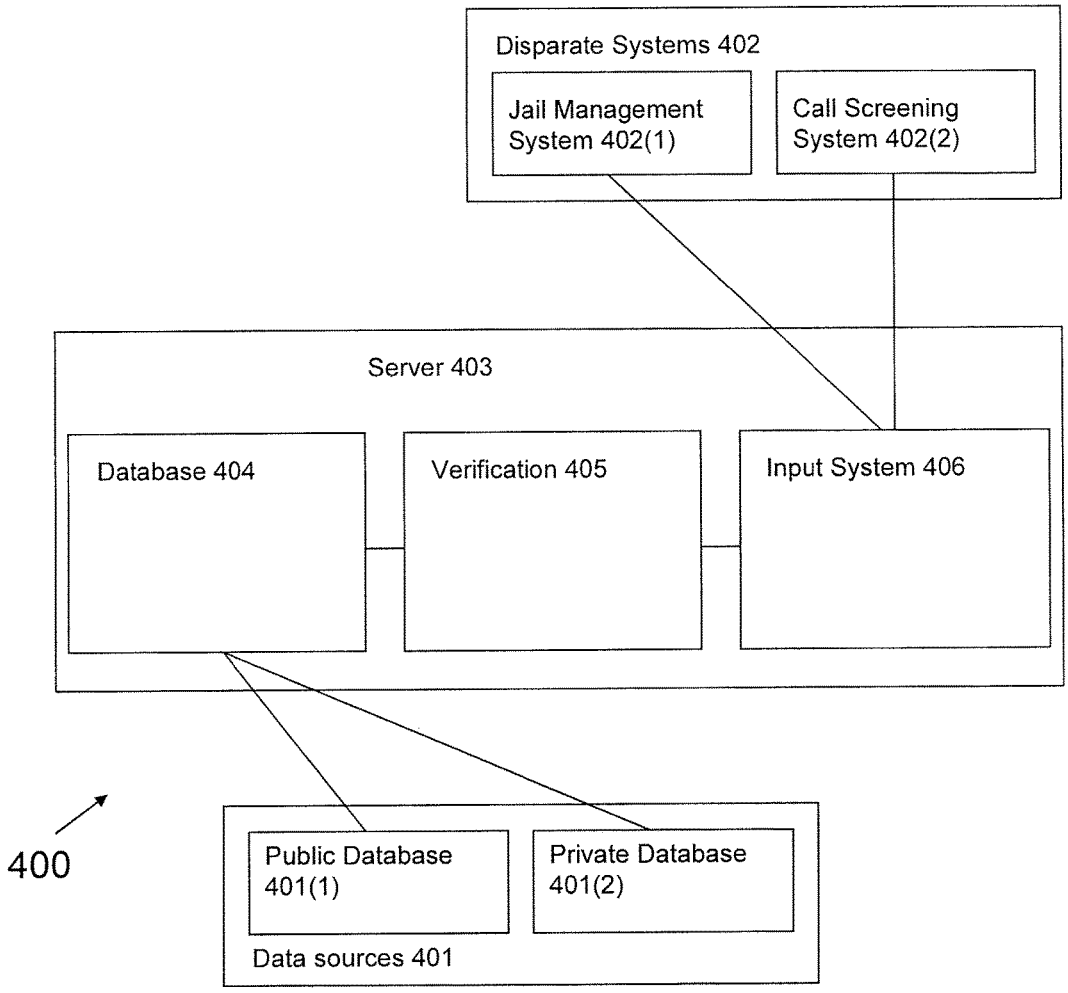
FIG. 4 is a diagram illustrating one embodiment of the system according to aspects of the present disclosure.

FIG. 4 is a diagram illustrating one embodiment of a system 400 according to aspects of the present disclosure. The system 400 includes a server 403 comprising a database 404, a verification system 405, and an input system 406. The server 403 is programmed to perform one, all, or a combination of the methods 100, 200, 300 disclosed herein. The database 404 is populated with identity information from various data sources 401, such as, a public database 401(1) or a private database 401(2). Public databases 401(1) may include a line information database, best known name and address database, social security database, national financial information database, national passport database, government issued identification database, warrants database, national victim network database, or "do not contact" database. Private databases 401(2) may include databases aggregated by the detention environment itself. In some cases the identity information from the data source 401 existed prior to the individual's interaction with the individual subject to the detention environment. The database 404 may also be populated by the data sources upon command, at intervals, or dynamically.

The system 400 is preferably compatible with data sources 401, such as e.g., the interactive audio/video system and device for use in a detention environment disclosed in U.S. patent application Ser. No. 13/088,883, the consolidated voicemail platform disclosed in U.S. patent application Ser. No. 12/826,168, an information exchange facilitating system such as e.g., the secure social network disclosed in U.S. patent application Ser. No. 13/438,940.

When an individual inputs information through one of the disparate systems 402 for managing detention environment interactions, such as a jail management system 402(1) or call screening system 402(2), the server 403 receives that information through its input system 406. The verification system 405 takes the information obtained through the input system 406 and verifies the identifying information by matching it with the information stored in the database 404.

In accordance with the practices of persons skilled in the art of computer programming, embodiments of the method 100, 200, 300 are described with reference to operations that are performed by a computer system or a like electronic system. Such operations are sometimes referred to as being computer-executed. It will be appreciated that operations that are symbolically represented include the manipulation by a processor, such as a central processing unit, of electrical signals representing data bits and the maintenance of data bits at memory locations, such as in system memory, as well as other processing of signals. The memory locations where data bits are maintained are physical locations that have particular electrical, magnetic, optical, or organic properties corresponding to the data bits. Embodiments may also encompass integrated circuitry including circuit elements capable of performing specific system operations.

When implemented in a programmed device or system, the elements of the embodiments are essentially the code segments to perform the necessary tasks. The non-transitory code segments may be stored in a processor readable medium or computer readable medium, which may include any medium that may store or transfer information. Examples of such media include an electronic circuit, a semiconductor memory device, a read-only memory (ROM), a flash memory or other non-volatile memory, a floppy diskette, a CD-ROM, an optical disk, a hard disk, a fiber optic medium, etc. User input may include any combination of a keyboard, mouse, touch screen, voice command input, etc. User input may similarly be used to direct a browser application executing on a user's computing device to one or more network resources, such as web pages, from which computing resources may be accessed.

While the invention has been described in connection with specific examples and various embodiments, it should be readily understood by those skilled in the art that many modifications and adaptations of the invention described herein are possible without departure from the spirit and scope of the invention as claimed hereinafter. Thus, it is to be clearly understood that this application is made only by way of example and not as a limitation on the scope of the invention claimed below. The description is intended to cover any variations, uses or adaptation of the invention following, in general, the principles of the invention, and including such departures from the present disclosure as come within the known and customary practice within the art to which the invention pertains.

What is claimed is:

1. A method of identifying a first individual attempting to interact with a second individual, wherein the first individual is not associated with a detention environment and the second individual being associated with the detention environment, said method comprising:

storing identity information of the first individual from a data source into a centralized database, the centralized database being accessible by disparate interactions related to the detention environment;

receiving identity information from the first individual when attempting to interact with the second individual;

verifying the first individual by comparing the received identity information to the stored identity information in the centralized database; and allowing the interaction between the first individual and the second individual only when there is a match between the received identity information and the stored identity information, wherein the data source is at least one of a line information database, a best known name and address database, social security database, national financial information database, national passport database, government issued identification database, warrants database, national victim network database, or "do not contact" database.

2. The method of claim 1, wherein the storing step occurred prior to the first individual's interaction with the second individual.

3. The method of claim 2, further comprising supplementing the centralized database with the received information and a record of the attempted interaction.

4. The method of claim 1, wherein the verifying step further comprises requesting additional identity information from the first individual until the first individual is verified.

5. The method of claim 1, further comprising establishing permissible interactions between the first individual and the second individual.

6. The method of claim 1, wherein the identity information from the first individual is received through at least one of a scanner, keying in a unique phrase or number that was sent to a phone, or answering a call made to the individual's phone.

7. The method of claim 1, wherein the identity information from the first individual is at least one of a government issued identification document, personal information, or biometric information.

8. The method of claim 7, wherein the biometric information is at least one of facial recognition, body recognition, voice recognition, retinal scan, fingerprint, DNA sample, or palm print.

9. The method of claim 1, wherein an interaction includes at least one of visitation, monetary deposit, bail or bond payment, telephone call, voicemail message, or video call.

10. A system for identifying a first individual attempting to interact with a second individual, wherein the first individual is not associated with a detention environment and the second individual being associated with the detention environment, said system comprising:

a centralized database to store identity information of the first individual from a data source, the centralized database being accessible by disparate systems related to the detention environment;

an input receiver that receives identity information from the first individual when attempting to interact with the second individual; and a verification system that compares the received identity information to the stored identity information in the centralized database and allows the interaction between the first individual and the second individual only when there is a match between the received identity information and the stored identity information, wherein the data source is at least one of a line information database, a best known name and address database, social security database, national financial information database, national passport database, government issued identification database, warrants database, national victim network database, or "do not contact" database.

11. The system of claim 10, wherein the identity information from the data source is stored prior to the first individual's interaction with the second individual.

12. The system of claim 11, wherein the centralized database is supplemented with the received information and a record of the attempted interaction.

13. The system of claim 10, the verification system further comprising requests for additional identity information from the individual until the individual is verified.

14. The system of claim 10, further comprising a permissions system for establishing permissible interactions between the individual and the individual subject to the detention environment.

15. The system of claim 10, wherein the identity data from the first individual is received through at least one of a scanner, keying in a unique phrase or number that was sent to a phone, or answering a call made to the individual's phone.

16. The system of claim 10, wherein the identity information from the first individual is at least one of a government issued identification document, personal information, or biometric information.

17. The system of claim 16, wherein the biometric information is at least one of facial recognition, body recognition, voice recognition, retinal scan, fingerprint, DNA sample, or palm print.

18. The system of claim 10, wherein an interaction includes at least one of visitation, monetary deposit, bail or bond payment, telephone call, voicemail message, or video call.

* * * * *